US006709689B2

(12) United States Patent
Koyanagi et al.

(10) Patent No.: US 6,709,689 B2
(45) Date of Patent: Mar. 23, 2004

(54) DRAWN YARN PACKAGE AND PRODUCTION METHOD THEREFOR

(75) Inventors: Tadashi Koyanagi, Nobeoka (JP); Takao Abe, Nobeoka (JP); Akira Yamashita, Nobeoka (JP)

(73) Assignee: Asahi Kasei Kabushiki Kaisha, Osaka (JP)

( * ) Notice: Subject to any disclaimer, the term of this patent is extended or adjusted under 35 U.S.C. 154(b) by 0 days.

(21) Appl. No.: 10/332,009

(22) PCT Filed: Jul. 5, 2001

(86) PCT No.: PCT/JP01/05858

§ 371 (c)(1),
(2), (4) Date: Jan. 3, 2003

(87) PCT Pub. No.: WO02/04332

PCT Pub. Date: Jan. 17, 2002

(65) Prior Publication Data

US 2003/0161979 A1 Aug. 28, 2003

(30) Foreign Application Priority Data

Jul. 6, 2000 (JP) ..... 2000-205080
Apr. 24, 2001 (JP) ..... 2001-126145

(51) Int. Cl.[7] ..... D01F 6/00; D01F 6/62; D01D 5/92; D01G 1/16

(52) U.S. Cl. ..... 426/364; 428/395; 264/103; 264/130; 264/211.12; 264/211.14; 206/392

(58) Field of Search ..... 428/364, 395; 206/392; 264/103, 130, 211.12, 211.14

(56) References Cited

U.S. PATENT DOCUMENTS

| | | | |
|---|---|---|---|
| 5,645,782 A | 7/1997 | Howell et al. | 264/103 |
| 6,284,370 B1 | 9/2001 | Fujimoto et al. | 428/364 |

FOREIGN PATENT DOCUMENTS

| | | |
|---|---|---|
| JP | 6-287810 | 10/1994 |
| JP | 9-175731 | 7/1997 |
| JP | 11-172526 | 6/1999 |
| JP | 11-302919 | 11/1999 |
| JP | 2000-73230 | 3/2000 |
| JP | 3-73963 | 6/2000 |
| JP | 2000-239921 | 9/2000 |
| WO | WO 99/27168 | 6/1999 |
| WO | WO 01/85590 | 11/2001 |

*Primary Examiner*—N. Edwards
(74) *Attorney, Agent, or Firm*—Finnegan, Henderson, Farabow, Garrett & Dunner, L.L.P.

(57) ABSTRACT

The present invention provides a package of poly (trimethylene terephthalate) drawn yarn obtained by a direct spin-draw process of poly(trimethylene terephthalate), having an industrially practical winding amount and excellent in unwindability during high speed unwinding after storage over a long period of time, and a method for producing the same. A fabric obtained by weaving or knitting using a package of poly(trimethylene terephthalate) drawn yarn of the invention has good quality without defects such as streaky defects and a tight yarn.

8 Claims, 6 Drawing Sheets

DRAWN YARN PACKAGE AND PRODUCTION METHOD THEREFOR

FIELD OF INVENTION

The present invention relates to a package of poly (trimethylene terephthalate) drawn yarn obtained by a direct spin-draw process, and a method for producing the same.

BACKGROUND ART

Poly(ethylene terephthalate) (hereinafter referred to as PET) fibers are mass-produced around the world as synthetic fibers most suitable for clothing applications, and the production thereof has become a large industry.

Poly(trimethylene terephthalate) (hereinafter referred to as PTT) fibers are known in the prior art as disclosed in the following references: (A) J. Polymer Science: Polymer Physics Edition, Vol. 14 p 263–274 (1976); (B) Chemical Fibers International, Vol. 45, p110–111 April (1995); (C) Chemical Fibers International, Vol. 47, p72 February (1997); and (D) WO 99/27168.

The references (A) and (B) of the prior art describe the fundamental properties of the stress-elongation characteristics of PTT fibers, and suggest that the fibers are suitable for clothing and carpet applications because the PTT fibers show small initial modulus and, in comparison with nylon and PET fibers, they are excellent in elastic recovery.

Moreover, the reference (C) of the prior art describes a direct spin-draw process. The reference (D) of the prior art describes PTT fibers obtained by a direct spin-draw process; it describes that when the PTT fibers show appropriate breaking elongation, thermal stress and boil-off shrinkage, knitted or woven fabrics for which the PTT fibers are used can manifest a low elastic modulus and a soft feeling. The reference (D) of the prior art further describes that such PTT fibers are appropriate to clothing such as innerwear, outerwear, sportswear, hosiery, lining cloth and swimwear.

The reference (D) of the prior art discloses as follows. A drawn yarn obtained by a direct-spin draw process significantly shrinks during and after winding, and the end surfaces of the resultant package come to have a swollen shape called bulging. As a result, a good package is hard to obtain. Moreover, even taking a package having such a bulging shape out of the winder becomes difficult.

The investigation by the present inventors has elucidated that the package of drawn yarn obtained by a direct spin-draw process has problems to be explained below other than those described by the above references of prior art.

a. Formation of High Edges and Pressing

A PTT drawn yarn is very sensitive to temperature and humidity. Specifically, heat generated from the motor itself of the winder during winding is transferred to the package through the bobbin axis, and the package temperature rises. Moreover, heat generated by friction between the package and the contact roll also raises the package temperature. As a result, the drawn yarn in the package shrinks.

The shrinkage of the drawn yarn is not produced substantially in both edge portions of the wound package having high hardness. It is produced in the other portion, namely, in only a drawn yarn wound in the central portion. As a result, the package comes to have a high edge winding shape during winding. When the package has a high edge shape, the edge portions alone are subsequently contacted with the contact roll, and frictional heat generation increasingly concentrates in the edge portions with an increase in a winding amount. Consequently, a package wound in such a manner to have a given winding diameter not only has a high edge winding form but is also in a state in which drawn yarns wound in each edge portion are pressed by the heat.

A study by the present inventors has clarified that such shrinkage of a drawn yarn caused by heat generation of the package is greatly influenced by dry thermal shrinkage stress of the drawn yarn.

b. Aging During Storage

A package of drawn yarn produced is seldom provided to the subsequent processing immediately, and is usually used after a storing period from one month to one year. Moreover, the storage temperature reaches a temperature as high as from about 30 to 40° C. when it is hot.

When the package is stored over a long period of time at such high temperature, the PTT drawn yarn shrinks resulting in package tightening and, as a result, a high edge and bulging shapes are made more significant. Moreover, the PTT drawn yarn wound in the edge portions of the package has a high density as the filaments thereof were adhered each other due to shrinkage.

FIG. 1 is a view schematically showing a package having a normal winding shape. FIG. 2 is a view schematically showing a package deformed to have a high edge. In addition, the reference numerals 20, 21 in FIG. 1 designate a bobbin and a package, respectively; the signs $\alpha$, $\beta$ in FIG. 2 designate the diameter of the edge portion and the diameter of the central portion, respectively.

c. High Speed Unwindability

For lining cloth and innerwear applications, a plain weave fabric the structure of which is represented by taffeta, twill, or the like, and a warp knitted fabric such as tricot are employed. Because a PTT drawn yarn is used without further processing such as false twisting in these fabrics, fibers are regularly arranged in the fabrics. As a result, there is the problem that fine defects present in the fibers remain intact and tend to be manifested as qualitative defects such as "warp streaks", "tight pick", or "uneven dyeing."

As cost competition has become severe in recent years, the processing rate is made high even in the weaving or knitting stage in order to correspond to the competition. For example, the rate of warping that is a stage of preparing the warp yarn of a woven fabric is made as high as from 500 to 1,000 m/min, while the rate was formerly from 100 to 200 m/min. The industrial weaving rate of a weft yarn with a weaving machine is currently from 800 to 1,500 m/min.

When a drawn yarn is unwound at high speed from a package of PTT drawn yarn having been stored at high temperature over a long period of time, yarn breakage increases, and unwinding tension fluctuation corresponding to a yarn length from one end surface to the opposite one of the package is generated. When a difference between the maximum and the minimum value of the tension fluctuation (hereinafter referred to as an unwinding tension difference) is large, qualitative defects are formed in the woven or knitted fabric.

FIG. 3 is a chart showing the fluctuation of an unwinding tension observed when a drawn yarn is unwound at high speed from a package having a good winding shape as shown in FIG. 1. FIG. 4 is a chart showing the fluctuation of an unwinding tension observed when a drawn yarn is unwound at high speed from a package having a high edge winding shape as shown in FIG. 2.

In FIGS. 3 and 4, the abscissa indicates a yarn length of a drawn yarn and the ordinate indicates an unwinding tension (g).

Although the reference (D) of the prior art mentioned above proposes the solution of package tightening during winding and reduction of bulging, it does not refer to the formation of a high edge and pressing caused by heat generation of a package during winding, package tightening caused by aging, and problems produced by the package tightening when the package is unwound at high speed.

The reference (D) of the prior art describes that a weight of the yarn wound into a package must be made 2 kg or less, and discloses an embodiment of a package having a winding width as long as 300 mm, and a winding weight of from 1 to 1.5 kg (corresponding to a winding diameter of 130 mm). However, when a package having such a small winding amount is unwound at high speed, replacement of an old package with a new one must be frequently conducted. The use of such a package is therefore industrially disadvantageous. Moreover, because the winding width is large, there is the problem that the unwinding tension difference between one end surface and the other end one of a yarn length in the package is large. The reference (D) of the prior art describes only one embodiment of a package having a wound yarn in an amount of 5 kg. Because the dry thermal shrinkage stress of the yarn is as high as from 0.22 to 0.30 cN/dtex, the package shows during storage significant package tightening caused by shrinkage by aging. As a result, the unwinding tension fluctuation increases, and the high speed unwindability is poor.

Furthermore, Japanese Unexamined Patent Publication (Kokai) No. 2000-239921 (E) describes a proposition of an improvement of the package tightening and winding shape during winding for the same purpose as in the reference (D) of the prior art. However, the patent publication neither describes nor suggests a high edge and pressing caused by heat generation of a package during winding, and the aging and high speed unwindability of a package.

Japanese Patent Publication No. 3073963 (F) discloses that a cheese-like package having a small bulging ratio can be obtained by winding the drawn yarn while the yarn is being relaxed by cooling prior to winding. However, there is an antinomy relationship between a reduction of a bulging ratio and a solution of a high edge; a reduction of a bulging ratio is nothing but an enlargement of a high edge. Moreover, the patent publication neither describes nor suggests the influence of the dry thermal shrinkage stress of a drawn yarn on the formation of a high edge, and the problems of the formation of a high edge and pressing caused by heat generation of the package during winding.

On the other hand, Japanese Unexamined Patent Publication (Kokai) No. 9-175731 (G) describes a winding method wherein the traverse angle is varied in accordance with a winding diameter in winding a synthetic fiber. The method is effective in solving the problems of bulging and a wound yarn edge drop. However, for such a drawn yarn that shrinks in a package as time advances as a PTT fiber, the problems of a high edge and poor unwindability have not been solved. Moreover, the patent publication neither describes nor suggests the problems of the formation of a high edge and pressing caused by the heat generation of a package during winding.

The references (D) to (G) of the prior art disclose several propositions relating to a direct spin-draw process. However, they neither disclose nor suggest problems relating to the high speed unwindability of a package of PTT drawn yarn having an industrially practical winding weight, and methods of solving the problems.

DISCLOSURE OF THE INVENTION

The present invention is described below in 1 to 8. 1. A package of PTT drawn yarn that is a cheese-like package formed by winding a drawn yarn in a winding amount of 2 kg or more obtained by directly spinning and drawing a PTT comprising 95% by mole or more of trimethylene terephthalate repeating units, the package satisfying the following requirements (1) to (4):

(1) the drawn yarn shows a dry thermal shrinkage stress of from 0.01 to 0.15 cN/dtex;

(2) the traverse angle is varied in accordance with a winding diameter of the package and is selected from 3 to 10 degrees at each winding diameter, and the difference between the minimum and the maximum value thereof is at least one degree;

(3) the diameter difference between the edge portion and the central portion of the package is 10 mm or less; and (4) the unwinding tension difference ΔF (cN/dtex) during unwinding the drawn yarn having been wound into the package satisfies the following formula (1):

$$\Delta F \leqq 8.0\times10^{-6}u \quad (1)$$

wherein u is an unwinding speed (m/min).

2. The package of PTT drawn yarn according to 1, wherein the dry thermal shrinkage stress of the drawn yarn is from 0.02 to 0.13 cN/dtex.

3. The package of PTT drawn yarn according to 1 or 2, wherein the winding width of the package is from 60 to 200 mm, and the winding diameter thereof is from 200 to 400 mm.

4. The package of PTT drawn yarn according to any one of 1 to 3, wherein the traverse angle in the wound portion having a winding thickness exceeding 10 mm is larger than that in the wound portion having a winding thickness of 10 mm or less.

5. The package of PTT drawn yarn according to any one of 1 to 4, wherein the breaking elongation of the drawn yarn is from 40 to 90%.

6. A method for producing a package of PTT drawn yarn, wherein a PTT is drawn and heat treated using at least two pairs of godet rolls, in a direct spin-draw process of PTT, and the drawn yarn is wound into a package, the method satisfying the following requirements (a) to (d) during winding:

(a) the drawing tension is from 0.05 to 0.45 cN/dtex;

(b) the ratio $V/R_2$ of a winding speed V (m/min) to a final heat treatment godet roll speed $R_2$ (m/min) satisfies the following formula (2):

$$0.8 \leqq V/R_2 \leqq -6.6\times10^{-5}R_2+1.15 \quad (2)$$

provided that the final heat treatment godet roll speed $R_2$ is from 2,300 to 4,500 m/min;

(c) the traverse angle of winding during winding the drawn yarn into a package from the start to the end of winding is varied from 3 to 10 degrees in accordance with a winding diameter; and (d) the package during winding the drawn yarn is cooled to a temperature of 30° C. or less.

7. The method for producing a package of PTT drawn yarn according to 6, wherein during winding a drawn yarn into a package by a direct spin-draw process, the drawn yarn is wound with a winder having both a bobbin axis and a contact roll contacted with the bobbin axis each having a driving force while the peripheral speed $V_c$ (m/min) of the contact roll is being made larger than the winding speed V (m/min) by 0.3 to 2%.

8. The method for producing a package of PTT drawn yarn according to 6 or 7, wherein the winding speed is from 1,800 to 3,800 m/min.

An object of the present invention is to provide a package of PTT drawn yarn obtained by a direct spin-draw process of PTT, having an industrially practical winding amount and an improved winding shape, and showing excellent high speed unwindability even after storage over a long period of time, and a method for producing the same.

In more detail, an object of the present invention is to provide a package of PTT drawn yarn formed by winding a PTT drawn yarn that is suitable for clothing, having an industrially practical winding weight when used for a knitted or woven fabric, false twisting, or the like, and showing excellent high speed unwindability even after storage over a long period of time, and a method for stably producing the same.

The present invention improves the dyeing quality of fabrics that has been poor before due to the poor unwindability of the package of PTT drawn yarn.

As a result of intensively carrying out investigations to solve the problems mentioned above, the present inventors have discovered that the above problems can be solved by specifying, in producing a package of PTT drawn yarn by a direct spin-draw process, a combination of dry thermal shrinkage properties of the drawn yarn and winding conditions of the package, and the like, and the present invention has thus been achieved.

The present invention will be explained below in detail.

(A) The package of PTT drawn yarn of the present invention will be explained.

In the present invention, a PTT polymer forming a PTT drawn yarn comprises 95% by mole or more of trimethylene terephthalate repeating units and 5% by mole or less of repeating units of other esters.

That is, a PTT polymer forming the PTT drawn yarn of the invention is a PTT homopolymer or a PTT-copolymerized polymer comprising 5% by mole or less of repeating units of other esters.

Examples of the copolymerization components are shown below.

Examples of the acid component includes aromatic dicarboxylic acids represented by isophthalic acid and 5-sodium sulfoisophthalic acid, and aliphatic dicarboxylic acids represented by adipic acid and itaconic acid. Examples of the glycol component include ethylene glycol, butylene glycol and polyethylene glycol. Moreover, hydroxycarboxylic acids such as hydroxybenzoic acid are also included. A plurality of these components may also be copolymerized.

Furthermore, the PTT drawn yarn of the present invention may be made to contain or copolymerized with, as long as the effects of the present invention are not marred, additives such as delustering agents (such as titanium oxide), thermal stabilizers, antioxidants, antistatic agents, ultraviolet ray absorbers, antibacterial agents and various pigments.

In the present invention, the intrinsic viscosity of a PTT yarn prior to drawing and orienting is preferably from 0.7 to 1.3 dl/g, more preferably from 0.8 to 1.1 dl/g. When the intrinsic viscosity is in the above range, the strength of the drawn yarn is adequate, and a fabric having mechanical strength usable for sports applications, that require strength, can be obtained. Moreover, the drawn yarn can be stably produced because yarn breakage never takes place in the production stage of the drawn yarn.

In the present invention, a known process can be applied to the method for producing a PTT polymer. A typical example of the process is a two-stage process wherein melt polymerization is conducted to increase the polymerization degree until the polymer has a given intrinsic viscosity, and solid state polymerization is subsequently conducted until the polymer has a polymerization degree corresponding to a predetermined intrinsic viscosity.

For the package of drawn yarn of the invention, the dry thermal shrinkage stress of the drawn yarn is from 0.01 to 0.15 cN/dtex, preferably from 0.02 to 0.13 cN/dtex. When the drawn yarn having a thermal shrinkage stress in this range is used for a knitted or woven fabric, the resultant fabric shrinks during finishing stage after dyeing to give a knitted or woven fabric having a good feeling. Moreover, even when the winding diameter of the package of drawn yarn is made large, the package has no high edge, and shows good unwindability during high speed unwinding because the drawn yarn shrinks less during storage.

The package of drawn yarn of the invention preferably shows a breaking elongation of from 40 to 90%, more preferably from 45 to 65%.

When the breaking elongation of the drawn yarn is in this range, neither fluff formation nor yarn breakage of the drawn yarn takes place in a melt spinning-continuous drawing stage. Moreover, because the drawn yarn has no fluctuation in yarn size and shows a breaking strength of about 2 cN/dtex or more, a fabric excellent in strength and dyeing quality can be obtained.

The traverse angle of the package of drawn yarn of the present invention is varied in accordance with the winding diameter thereof. The traverse angle for each diameter is from 3 to 10°, preferably from 4 to 9°, and the difference between the minimum and the maximum value of the traverse angle is 1° or more, preferably 2° or more. When the traverse angle and the difference between the minimum and the maximum value of the traverse angle are in the above ranges, neither collapse of the package form nor high edge formation takes place. Moreover, the effect of varying a traverse angle is sufficiently shown, and normal winding can be conducted. The high edge of the package and the pressing of the drawn yarn in the edge portions can thus be avoided by varying a traverse angle in accordance with the winding diameter.

The traverse angle is an angle made by a drawn yarn, which is wound into a package, with the angle determined by the ratio of a winding speed to a traverse speed; it is an angle θ made by a drawn yarn wound crossing to form a cheese-shaped package as shown in FIG. 1. In general, the traverse angle is discriminated from a ribbon break practiced during winding for the purpose of avoiding a diamond pattern.

For the package of drawn yarn of the invention, the traverse angle of the drawn yarn in a wound portion having a winding thickness from the bobbin exceeding 10 mm is preferably larger than that in a wound portion having a winding thickness of 10 mm or less. A preferred embodiment of the traverse angle that is varied in accordance with a winding diameter is as follows: the traverse angle is made low at the start of winding, namely, in the inner layer of the package; the traverse angle is gradually increased as the winding diameter is increased, and made highest in the intermediate layer of the package; and the traverse angle is decreased again until the drawn yarn forms the outer layer.

For example, for a package having a winding thickness of 110 mm, the traverse angle is preferably selected as explained below. The traverse angle is from 3 to 6° for an inner layer having a winding thickness of 10 mm or less, from greater than 6 to 10° for an intermediate layer having a winding thickness of from greater than 10 to 60 mm, and from 3 to 7° for an outer layer having a winding thickness from greater than 60 to 110 mm.

As explained above, the drawn yarn is wound while the traverse angle is being varied in accordance with a winding diameter. As a result, both the bulging and high edge of the package can be reduced, and the high speed unwindability becomes good because a high edge and pressing in the edge portion are not produced.

The winding width of a package of drawn yarn in the present invention is preferably from 60 to 200 mm, more preferably from 80 to 190 mm; the winding diameter thereof is preferably from 200 to 400 mm, more preferably from 250 to 350 mm. When the winding width and winding diameter are in the above ranges, the unwinding tension difference is small, and good high speed unwindability can be obtained; moreover, a winding amount of about 2 kg or more that is an industrially useful one can be guaranteed.

In general, a paper bobbin having a diameter of from about 50 to 100 mm is employed to wind a drawn yarn for clothing obtained by a melt spinning-continuous drawing process.

For example, a package of drawn yarn formed on a bobbin with a diameter of about 100 mm, and having a winding width of 80 mm and a winding diameter of 250 mm has a winding weight of a drawn yarn of about 3 kg. Similarly, the package of drawn yarn has a winding weight of about 4 kg when the winding width is 200 mm and the winding diameter is 200 mm, and a winding weight of about 40 kg when the winding width is 200 mm and the winding diameter is 400 mm.

A package of drawn yarn having a larger winding weight is more industrially advantageous because a period of replacing a new package with an old one is extended even when high speed unwinding is conducted during the use. In general, easy handling of a package of drawn yarn is taken into consideration, and a winding weight of from 5 to 10 kg is industrially employed. The winding width and winding diameter of a package of drawn yarn having an industrially useful winding weight are selected from the ranges defined by the present invention.

The diameter difference between the edge portion and the central portion of the package of drawn yarn of the present invention is 10 mm or less. When the diameter difference is 10 mm or less, the unwinding tension difference is small, and the unwindability at high speed is good. A smaller diameter difference between the edge portion and the central portion of the package is preferred, and a diameter difference of 5 mm or less is more preferred because the unwinding tension difference becomes still smaller.

For the package of drawn yarn of the present invention, the unwinding tension difference ΔF (cN/dtex) during unwinding the drawn yarn having been wound thereinto satisfies the following formula:

$$\Delta F \leqq 8.0\times10^{-6}u \quad (1)$$

wherein u is an unwinding speed (m/min).

The formula (1) shows the dependence of the unwinding tension difference of the package of drawn yarn on the unwinding speed. When the unwinding tension difference satisfies the range of the formula (1), neither yarn breakage nor tight yarn nor dyeing defects nor the like caused by the unwinding tension fluctuation of the package of drawn yarn takes place during knitting, weaving or false twisting.

It can be concluded from the formula (1) that for example, when the unwinding speed of a drawn yarn from the package is 1,000 m/min, the unwinding tension difference ΔF (cN/dtex) must be 0.008 cN/dtex or less.

The range of the unwinding tension difference in the present invention is, when understandably illustrated, in the range under the oblique line in FIG. 5. In FIG. 5, the abscissa indicates an unwinding speed u (m/min) during unwinding a drawn yarn from the package of drawn yarn, and the ordinate indicates an unwinding tension difference ΔF (cN/dtex).

Although there is no specific limitation on the yarn size or single filament size of a PTT drawn yarn in the present invention, the yarn size is preferably from 20 to 300 dtex, more preferably from 30 to 150 dtex, and the single filament size is preferably from 0.5 to 20 dtex, more preferably from 1 to 3 dtex.

The PTT drawn yarn to be used may also be a conjugate yarn prepared by composing PTTs differing from each other in intrinsic viscosity, in a side-by-side manner or in an eccentric sheath-core manner. Moreover, the single filament cross section of the PTT drawn yarn may have a modified cross-sectional shape such as a round shape, a Y shape and a W shape, a hollow cross-sectional shape, or the like. There is no specific limitation on the cross-sectional shape.

Furthermore, in order to impart surface smoothness, convergence and antistatic properties to the PTT drawn yarn, a finishing agent may preferably be applied thereto in an amount of from 0.2 to 2% by weight. Still furthermore, in order to further improve the unwindability and convergence during false twisting, filaments interlacing may also be imparted in an amount of preferably 50 points/m or less, more preferably from 2 to 20 points/m.

(B) The production method of the present invention will be explained.

A preferred example of the method for producing a package of PTT drawn yarn in the present invention is illustrated below using FIG. 6.

In FIG. 6, PTT pellets dried with a drying machine 1 to have a moisture content of 30 ppm or less are fed to an extruder 2 set at temperature of from 255 to 265° C., and melted. The molten PTT is then transferred to a spin head 4 set at temperature of from 250 to 265° C. through a bend 3, and metered with a gear pump. The molten PTT is subsequently extruded into a spinning chamber, as multifilaments 7, through a spinneret 6 mounted on a spin pack 5 and having a plurality of nozzles.

The optimum temperatures of the extruder and spin head are selected from the ranges mentioned above while the intrinsic viscosity and shape of the PTT pellets are taken into consideration.

The PTT multifilaments extruded into the spinning chamber is cooled to room temperature with cooling air 8 to be solidified. A finishing agent is applied to the solidified filaments, taken up with take-up godet rolls (also playing the role of drawing) 10 rotated at a given rate, continuously drawn between the rolls 10 and final heat treatment godet rolls (drawing rolls) 11 without winding once, and wound by a winder as a package 12 of drawn yarn having a given size.

A finishing agent is applied to the solidified multifilaments 7 with a finishing agent applicator 9 before the multifilaments are contacted with the take-up godet rolls 10.

The finishing agent to be applied is preferably an aqueous emulsion type agent. The concentration of the aqueous emulsion as the finishing agent is preferably 10% by weight or more, more preferably from 15 to 30% by weight.

After applying a finishing agent, interlacing may optionally be imparted to the yarn by providing an interlacing apparatus. The number of interlacing is preferably from 1 to 50 points/m, more preferably from 2 to 10 points/m.

At least two pairs of godet rolls are used. For example, in FIG. 6, a pair of pretension rolls may also be provided before the take-up godet rolls. A yarn between the two pairs of godet rolls is drawn by a factor of from 1.2 to 3, by varying the peripheral speed of the godet rolls. During drawing, the first godet roll temperature is preferably from 50 to 70° C., more preferably from 55 to 60° C.

The yarn subsequent to drawing is subjected to necessary heat treatment by the second godet rolls. The heat treatment temperature is preferably from 100 to 150° C., more preferably from 110 to 130° C.

In the production method of the present invention, the drawing tension is from 0.05 to 0.45 cN/dtex, preferably from 0.15 to 0.40 cN/dtex. When the drawing tension is in the above range, the strength of the drawn yarn becomes about 2 cN/dtex or more. As a result, the yarn has a sufficient mechanical strength, and the breaking elongation becomes 40% or more; neither fluff formation nor yarn breakage takes place during drawing, and the yarn can be industrially stably produced.

The drawing tension is a tension between the take-up godet rolls and the drawing godet rolls (the same as the final heat treatment godet rolls in FIG. 6), and is determined by selecting the ratio of a peripheral speed of the take-up godet rolls to a peripheral speed of the drawing godet rolls, namely, the drawing ratio, and the take-up godet roll temperature.

In the production method of the present invention, the drawn yarn is wound under the conditions that the ratio ($V/R_2$) of a winding speed V (m/min) to a final heat treatment godet roll speed $R_2$ (m/min) satisfies the formula (2):

$$0.8 \leqq V/R_2 \leqq -6.6\times10^{-5}R_2+1.15 \quad (2)$$

The speed ratio $V/R_2$ signifies a relax ratio from the final heat treatment godet rolls to winding. When $V/R_2$ is in the range shown by the formula (2), the tension of the yarn between the final heat treatment godet rolls and the winder is appropriate, and stabilized winding can be conducted. Moreover, because the dry thermal shrinkage stress of the drawn yarn is in the range defined by the present invention, no package tightening takes place.

The range satisfying the formula (2) is understandably illustrated by a region surrounded with a slightly thicker line in FIG. 7. In FIG. 7, the abscissa indicates a final heat treatment godet roll speed $R_2$, and the ordinate indicates the ratio $V/R_2$ of a winding speed V to a final heat treatment godet roll speed $R_2$.

In the present invention, as far as the formula (2) is satisfied, a drawn yarn is wound at such a speed ratio that the tension of the yarn between the final heat treatment godet rolls and the winder becomes preferably from 0.04 to 0.12 cN/dtex, more preferably from 0.04 to 0.07 cN/dtex. When the winding tension is in the above range, the package of drawn yarn never has a high edge or bulging.

In the present invention, the take-up godet roll speed is preferably 3,000 m/min or less. When the speed exceeds 3,000 m/min, the final heat treatment godet roll speed exceeds 4,500 m/min, and the shrinkage of a drawn yarn wound into a package becomes significant. The take-up godet roll speed is more preferably 2,000 m/min or less.

In the method for producing a package of drawn yarn of the invention, the final heat treatment godet roll speed $R_2$ is from 2,300 to 4,500 m/min, preferably from 2,500 to 3,500 m/min.

When the speed $R_2$ of the final heat treatment godet rolls is in the above range, the fluctuation of filaments is insignificant during a period in which the filaments are melt spun and wound round the first godet rolls, and the spin-draw process can be stably carried out. Moreover, because the drawn yarn during winding or the one having been wound into a package does not shrink substantially, neither a high edge nor swelling of the package side surfaces termed bulging is produced.

The winding speed V is preferably from 1,800 to 3,800 m/min or less. When the speed exceeds 3,800 m/min, the high speed winding not only lowers a winding tension but also makes the improvement of the unwindability of the package of drawn yarn tend to become difficult for reasons explained below. When the winding speed is higher, the drawn yarn is estimated to shrink in the state of a package of drawn yarn.

In the present invention, it is preferred that during winding a drawn yarn into a package in a direct spin-draw process of PTT, both the bobbin axis and the contact roll contacted therewith of a winder have a driving force. Accordingly, a winder to be used in the present invention preferably has a driving system in which both a bobbin axis 13 and a contact roll 14 to be contacted therewith each have a driving force.

In the production method of the invention, the drawn yarn is wound while the contact roll peripheral speed $V_c$ (m/min) is being made larger than the winding speed V (m/min) by preferably from 0.3 to 2%, more preferably from 0.5 to 1.5%. When the peripheral speed $V_c$ of the contact roll is made larger than the winding speed V by 0.3% or more, reduction of a high edge of the package of drawn yarn and reduction of bulging are more improved. When the peripheral speed ratio ($V_c$/V) is made 0.3% or more, shrinkage of a drawn yarn in the package can be suppressed even at a take-up godet roll speed of 3,000 m/min or less.

Although a larger peripheral speed ratio ($V_c$/V) more increases the effects of reducing a high edge and bulging of the package, the driving motor of the contact roll becomes excessively large in order to make $V_c$/V larger than 2%, and the winder is hardly designed.

In the production method of the present invention, during a period from the start to the end of winding a drawn yarn into a package, the yarn is wound while the traverse angle of winding is being varied in accordance with a winding diameter from 3 to 10°, preferably from 4 to 9°. When the traverse angle is in the above range, a yarn can be normally wound without winding collapse, and a high edge is not formed in the package. In addition, the traverse angle can be set by adjusting a winding speed and a traverse speed.

In the present invention, it is preferred to make the traverse angle of the outer layer larger than that of the inner layer. The inner layer of the package herein refers to a wound portion having a thickness from the bobbin of about 10 mm or less.

A preferred embodiment of varying a traverse angle in accordance with a winding diameter is as follows: at the start of winding, namely, in the inner layer of the package, the traverse angle is made low; it is gradually increased with a winding diameter, and made highest in the intermediate layer; thereafter, it is again decreased until the yarn to be wound reaches the outer layer. As explained above, both the bulging and the high edge can be made small by winding a drawn yarn while the traverse angle is being varied in accordance with a winding diameter.

Variation patterns of the traverse angle in accordance with a winding diameter are exemplified in FIG. 8. In FIG. 8, patterns a, b and c are preferred examples (in the present invention) of traverse angle variation; a pattern d is an example (comparative example) in which the traverse angle is not varied even when the winding diameter is varied.

In the production method of the present invention, a drawn yarn is wound while the package is being cooled during winding to temperatures of 30° C. or less, preferably about 25° C. or less, more preferably 20° C. or less. When the package temperature is 30° C. or less, the shrinkage of a wound drawn yarn is small, and the package has no high edge. A lower package temperature is preferred. A package showing still better unwindability can be obtained by winding a drawn yarn at temperature of about 25° C. or less and selecting other winding conditions.

Cooling the package during winding to 30° C. or less is achieved by surrounding the winder and cooling the peripheral temperature of the package with cooling air at about 20° C. or less. The winder to be used is preferably selected so that transfer of heat generated by the motor itself to the package through the bobbin axis can be suppressed.

Use of the PTT drawn yarn obtained in the present invention gives a knitted or woven fabric having good quality without defects such as streaky defects and tight yarn, and giving a soft feeling.

Drawn yarns alone obtained by the present invention may be used for producing woven or knitted fabrics. Alternatively, drawn yarns of the invention and other fibers may be blended and used for a part of the fabrics. Examples of the other fibers to be mingling composed include filaments yarns and short fibers of polyester, cellulose, nylon 6, nylon 66, acetate, acryl fiber, polyurethane (elastic fibers), wool and silk; however, the fibers are not restricted to the above examples.

The drawn yarn obtained by the present invention may be false twisted, and used as a textured yarn for a fabric. Moreover, the fabric may be entirely formed from the false-twisted yarn of the present invention. Alternatively, in order to obtain a knitted or woven fabric in which the false-twisted yarn and another fiber are mingling composed, the mingling composed yarn can be produced by various mingling methods. Examples of the methods include as follows: the false-twisted yarn and another fiber are subjected to interlace mingling; the yarn and another fiber are subjected to interlace mingling, and drawn and false twisted; the yarn or another fiber is false twisted, and both are subjected to interlace mingling; the yarn and another fiber are separately false twisted, and both are subjected to interlace mingling; the yarn or another fiber is Taslan textured, and both are subjected to interlace mingling; the yarn and another fiber are subjected to interlace mingling, and the resultant yarn is Taslan textured; the yarn and another fiber are subjected to Taslan mingling. The mingling composed yarn obtained by such a method as mentioned above is preferably imparted to interlacing in an amount of 10 points/m or more, more preferably from 15 to 50 points/m.

BRIEF DESCRIPTION OF DRAWINGS

In FIG. 1, the references numerals 20 and 21 designate a bobbin and a package, respectively.

In FIG. 2, the signs α and β designate the diameter of an edge portion and that of a central portion, respectively.

In FIGS. 3 and 4, the abscissa indicates a yarn length of a drawn yarn, and the ordinate indicates an unwinding tension (g).

In FIG. 6, the reference numerals designate as follows: 1: a drying machine; 2: an extruder; 3: a bend; 4: a spin head; 5: a spin pack; 6: a spinneret; 7: multifilaments; 8: cooling air; 9: a finishing agent applicator; 10: take-up godet rolls; 11: final heat treatment godet rolls; 12: a package of drawn yarn; 13: a contact roll; 14: a bobbin axis.

In FIG. 8, patterns a, b and c are preferred examples (in the present invention) of traverse angle variation; a pattern d is an example (comparative example) in which the traverse angle is not varied when the winding diameter is increased.

BEST MODE FOR CARRYING OUT THE INVENTION

The present invention will be further explained below by making reference to examples. However, it is needless to say that the present invention is not restricted thereto.

In addition, measurement methods, evaluation methods, and the like are as described below.

(1) Intrinsic Viscosity [η]

The intrinsic viscosity is a value determined on the basis of a definition of the following formula:

$$[\eta]=\lim_{C\to 0}(\eta_r-1)/C$$

wherein $\eta_r$ is a value obtained by dividing the viscosity at 35° C. of a diluted solution of a PTT polymer that is prepared by dissolving the polymer in an o-chlorophenol solvent with a purity of 98% or more by the viscosity of the solvent that is measured at the same temperature and defined as a relative viscosity, and C is a polymer concentration in terms of g/100 ml.

(2) Spinning Stability

Using a melt spinning-continuous drawing machine on which a spinning nozzle having 8 ends per spindle is mounted, melt spinning-continuous drawing is conducted for two days in each example.

The spinning stability is judged from a number of yarn breakage during the period, and a formation frequency of fluff (ratio of a number of fluff formation packages) present in the packages of drawn yarn thus obtained, according to the following criteria.

◎: No yarn breakage takes place, and the ratio of fluff formation packages is 5% or less.

○: Yarn breakage takes place twice or less, and the ratio of fluff formation packages is less than 10%.

X: Yarn breakage takes place three times or more, and the ratio of fluff formation packages is 10% or more.

(3) Breaking Strength, Breaking Elongation

The breaking strength and breaking elongation are measured in accordance with JIS L 1013.

(4) Diameter Difference (Degree of High Edge) of Package

Figure 1:
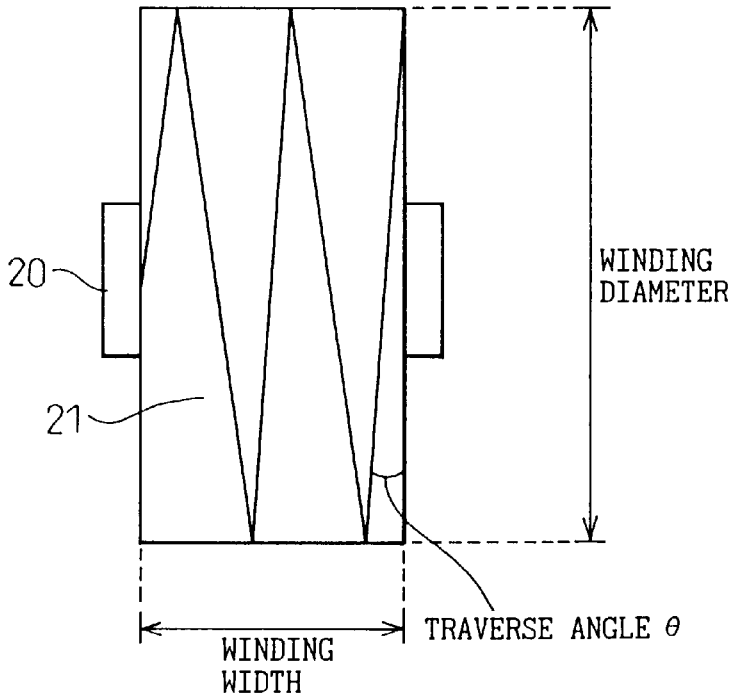
FIG. 1 is a view schematically showing a package having a normal winding shape.
Figure 2:
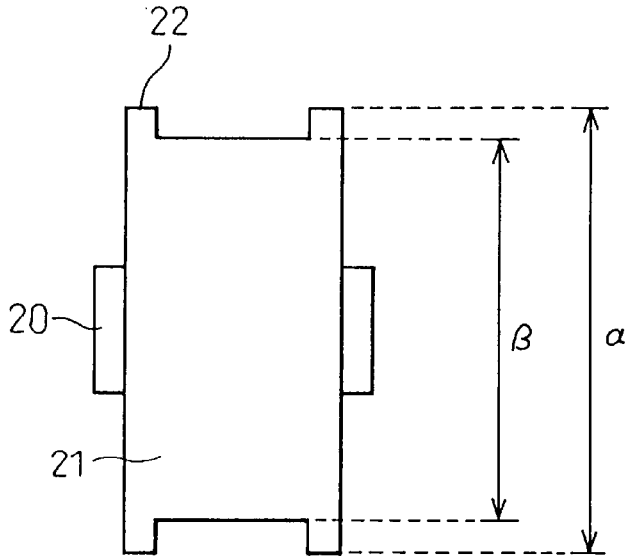
FIG. 2 is a view schematically showing one embodiment of a package deformed to have high edges.

The diameter α in the edge portion and the diameter β in the central portion of a package illustrated in FIG. 2 are measured, and the difference is obtained from the following formula:

$$\text{diameter difference } (mm)=\alpha-\beta$$

(5) Dry Thermal Shrinkage Stress

Measurements are made with a thermal stress measurement apparatus (trade name of KE-2, manufactured by Kanebo ENGINEERING, LTD). A drawn yarn is cut to give a yarn sample 20 cm long. Both ends of the sample are tied to form a ring, which is mounted on the measurement apparatus. Measurements are made under the following conditions: an initial load of 0.044 cN/dtex; and a heating rate of 100° C./min. A chart of thermal shrinkage stress vs. temperature is drawn during the measurements.

The temperature at which the thermal shrinkage stress starts to manifest on the chart is defined as the starting temperature of thermal stress manifestation. The thermal shrinkage stress draws a mountain type curve in the high temperature region. The temperature at which the peak value is manifested is defined as the extreme temperature, and the stress is defined as the extreme stress.

(6) Unwinding Tension Difference

A drawn yarn is unwound from a package of drawn yarn at a rate of 1,000 m/min, and the unwinding tension is recorded on a chart.

The tension is measured with a tensionmeter (trade name of MODEL 1500, manufactured by Eiko Sokki K. K.).

In each measurement, the tension is measured for 60 sec, and the tension fluctuation is recorded on a chart. The fluctuation width (g) of the unwinding tension is read from the measured results, and the unwinding tension difference is determined by dividing the fluctuation width by the size of the drawn yarn.

(7) Evaluation of Fabric

Fabrics are prepared as explained below.

A PTT drawn yarn of 56 dtex/24 f and a drawn yarn of 84 dtex/36 f are used as a warp yarn and a weft yarn, respectively, and a plain weave fabric is prepared from the yarns.

Warp density: 97 ends/2.54 cm

Weft density: 98 picks/2.54 cm

Weaving machine: trade name of Air Jet Loom ZA-103, manufactured by Tsudakoma Co., Ltd.

Weaving rate: 600 rpm (900 m/min)

The gray fabric thus obtained is scoured under the following conditions, and subjected to a series of treatments of dyeing and finish setting.

Scouring: An open soaper type continuous scouring machine (manufactured by Wakayama Tekko Co., Ltd.) is used. Sodium hydroxide is used in an amount of 5 g/l. The temperature is set at 100° C.

Presetting: A heat setter (manufactured by Hirano Kinzoku K. K.) is used. The presetting temperature is set at 180° C. The presetting time is 30 sec.

Dyeing: A circular dyeing machine (manufactured by HISAKA Works, LTD) is used. A dye (C. I. Disperse Blue 291) is used in an amount of 1%. A dispersing agent (trade name of Disper TL) is used in an amount of 1 g/l. The pH is adjusted with acetic acid in an amount of 0.5 ml/l. The dyeing temperature is set at 110° C. The dyeing time is 30 sec.

Finish setting: The finish setting temperature is set at 170° C. The finish setting time is 30 sec.

The fabric thus obtained is inspected by a skilled inspector, and the weft quality is judged according to the following criteria.

◎: The fabric has no defects such as tight yarn and nonuniformity, and is extremely good.

○: The fabric has no defects such as tight yarn and nonuniformity, and is good.

X: The fabric has tight yarn and nonuniformity, and is not good.

(8) Overall Evaluation

◎: Both the spinning stability and fabric quality are extremely good.

○: Both the spinning stability and fabric quality are good.

X: Neither the spinning stability nor the fabric quality is good.

EXAMPLES 1 TO 5

Comparative Examples 1 and 2

The effect of drawing tension will be explained in the present examples.

Figure 6:
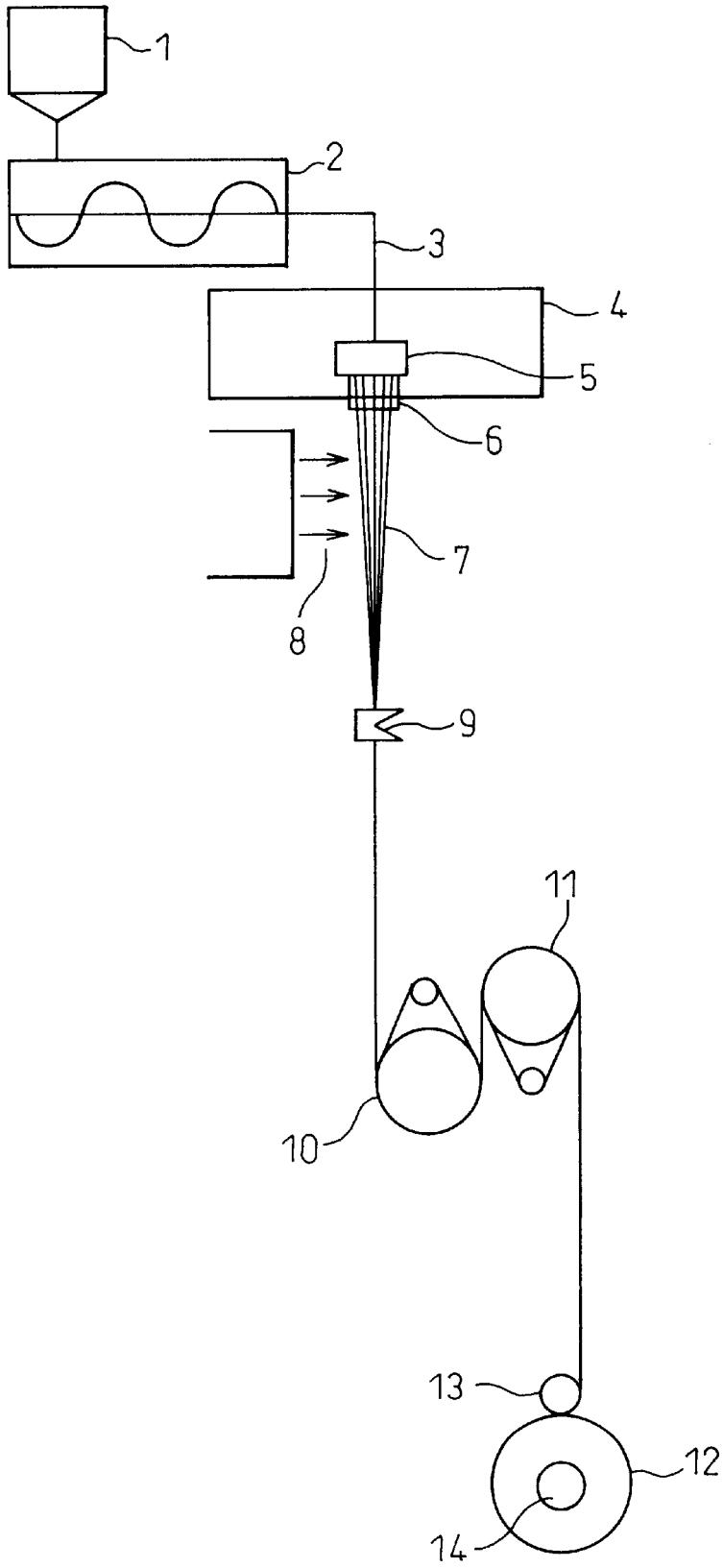
FIG. 6 is a schematic view showing one embodiment of the stage of producing a package of drawn yarn.
Figure 7:
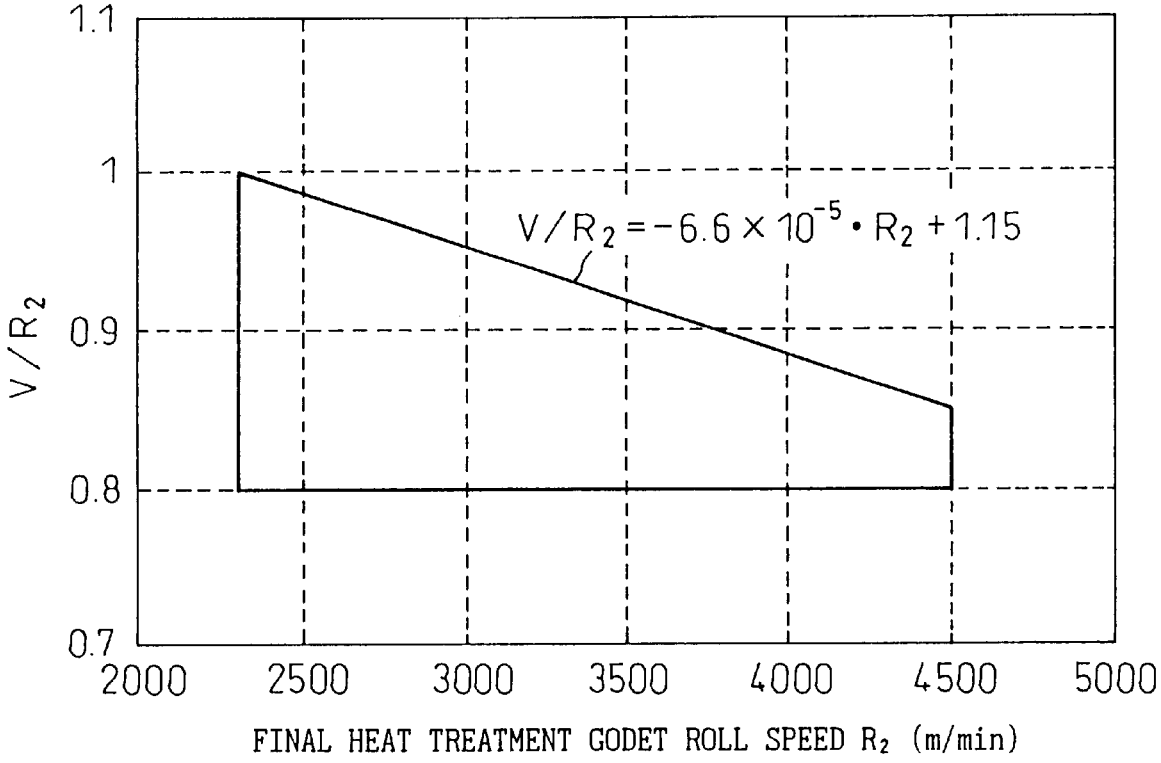
FIG. 7 is a graph showing a relationship between a final heat treatment godet roll speed and the ratio of a winding speed to a final heat treatment godet roll speed.

PTT pellets containing 0.4% by weight of titanium oxide and having an intrinsic viscosity of 0.91 was spun and continuously drawn using a spinning machine, a drawing machine and a winder as shown in FIG. 6.

The ratio of a winding speed to a speed of final heat treatment godet rolls (with a reference numeral of 11 in FIG. 6) was varied as shown in Table 1 during winding, and a PTT drawn yarn of 84 dtex/36 filaments was produced.

The spinning conditions in the present examples and comparative examples are as explained below.

(Spinning Conditions)

Drying temperature of pellets and moisture content attained: 110° C., 25 ppm

Extruder temperature: 260° C.

Spin head temperature: 265° C.

Spinning nozzle diameter: 0.40 mm

Injection amount of polymer: determined under each conditions so that the size of a drawn yarn becomes 84 dtex Conditions of cooling air: temperature of 22° C., relative humidity of 90%, blowing speed of 0.5 m/sec Finishing agent: aqueous emulsion of a finishing agent (concentration of 30% by weight) containing polyether ester as a major component Take-up godet roll speed: 1,200 m/min Take-up roll temperature: 55° C.

Final heat treatment godet roll temperature: 120° C.

Winder: Trade name of AW-909, manufactured by TEIJIN SEIKI CO., LTD, biaxially driven by a bobbin axis and a contact roll Outside diameter of winding paper bobbin: 108 mm Ratio of contact roll peripheral speed $V_c$/winding speed V: 1.007 (0.7%)

Figure 8:
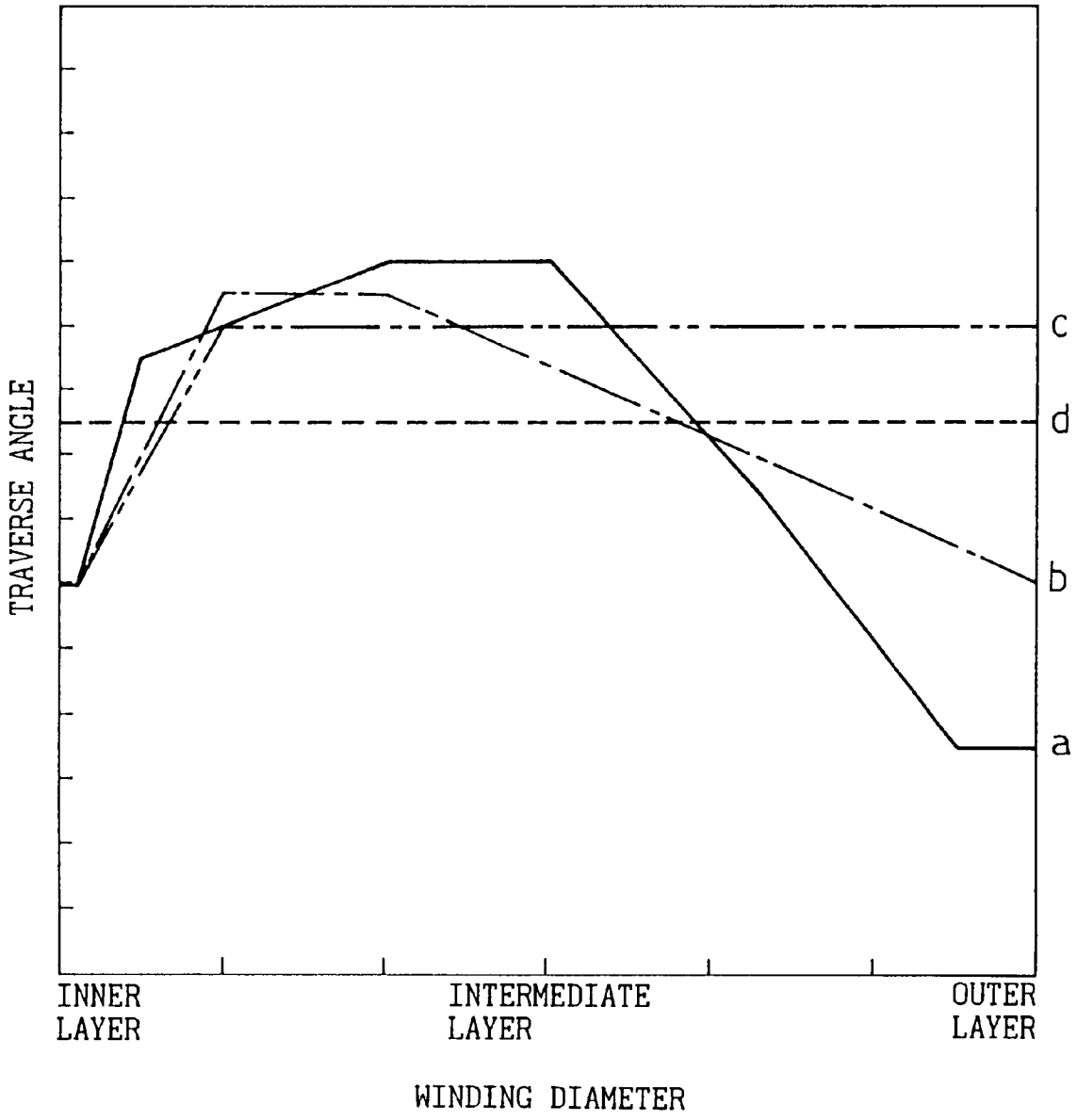
FIG. 8 is a graph showing examples of the pattern of a traverse angle variation corresponding to a winding diameter during winding.

Traverse angle: varied in a manner as shown by a pattern a in FIG. 8

Start of winding: 5.5°

Winding thickness of 10 mm: 7.5°

Winding thickness of 30 to 60 mm: 8.5°

Winding thickness of 60 to 100 mm: gradually decreasing from 8 to 4°

Winding thickness of 100 to 110 mm: 4°

Winding contact pressure: 2 kg/package

Winding tension: 0.04 cN/dtex

Package temperature during winding: 20° C. (measured with a noncontact thermometer)

(Package of Drawn Yarn)

Size/filaments: 83.2 dtex/36 f

Moisture content: 0.6% by weight

Winding width: 85 mm

Winding diameter: 320 mm

Yarn length from edge portion to opposite edge portion: 90 cm

Winding weight: 5.2 kg/bobbin

The wound package of drawn yarn was held in an environment at a temperature of 30° C. and a relative humidity of 90% for 60 days.

Table 1 shows the physical properties and unwindability (unwinding rate of 1,000 m/min) of the package of drawn yarn thus obtained.

Figure 3:
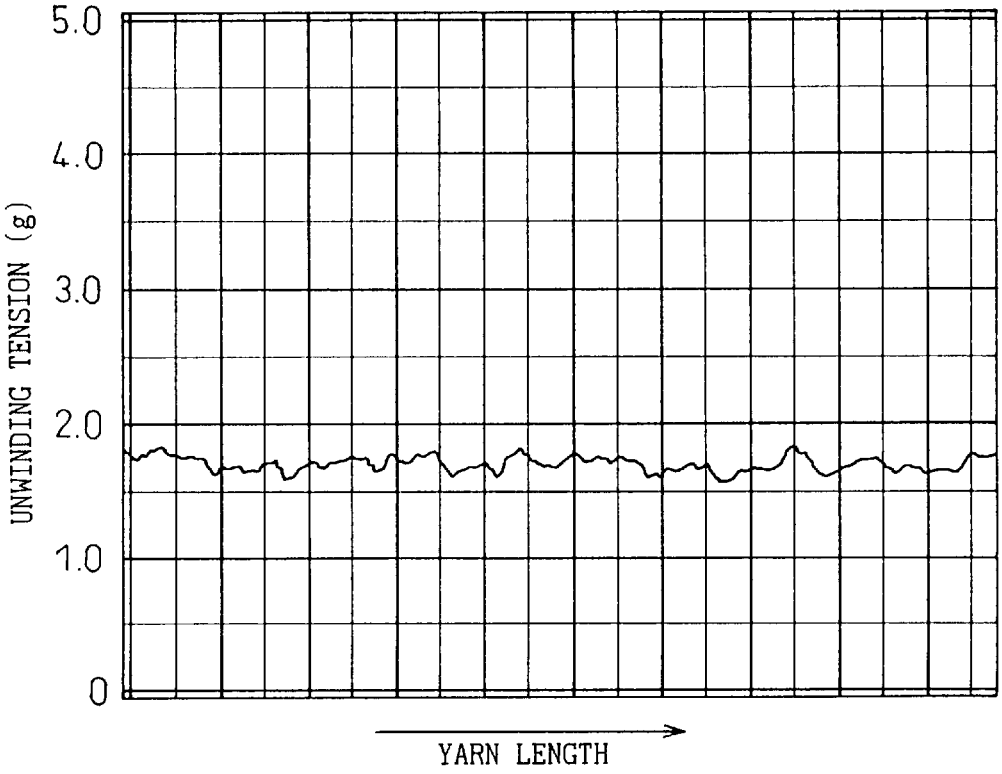
FIG. 3 is one example of a chart showing the fluctuation of an unwinding tension observed when a drawn yarn is unwound at high speed from a package having a good winding shape as shown in FIG. 1.

Moreover, FIG. 3 shows an unwinding tension fluctuation chart obtained when the package of drawn yarn in Example 4 was unwound at an unwinding speed of 1,000 m/min.

Figure 4:
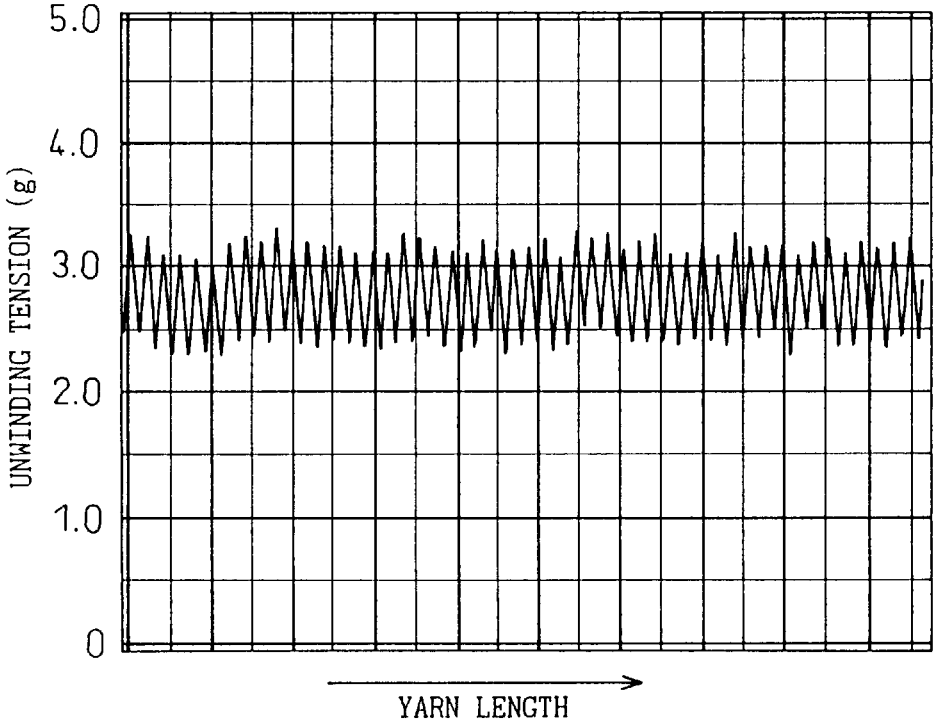
FIG. 4 is one example of a chart showing the fluctuation of an unwinding tension observed when a drawn yarn is unwound at high speed from a package having a high edge winding shape as shown in FIG. 2.
Figure 5:
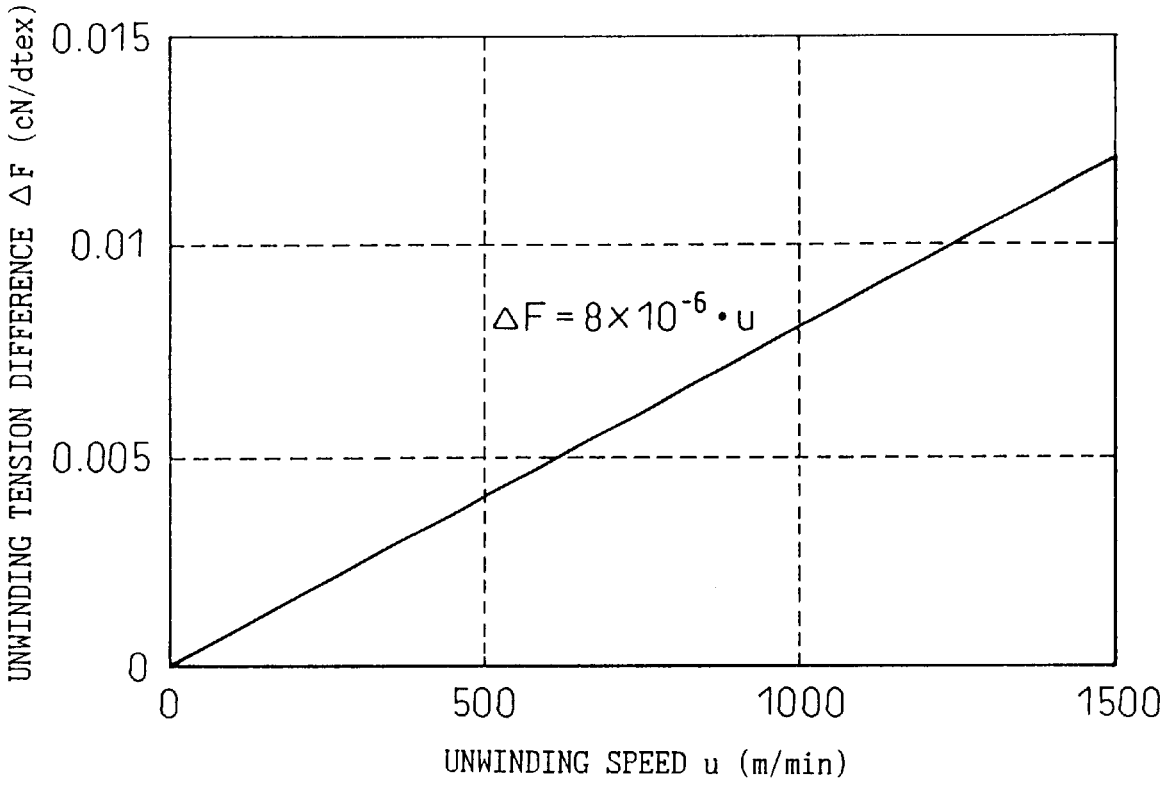
FIG. 5 is a graph showing a relationship between an unwinding speed and an unwinding tension difference during unwinding a drawn yarn wound into a package.

Similarly, FIG. 4 shows an unwinding tension fluctuation chart obtained when the package of drawn yarn in Comparative Example 1 was unwound at an unwinding speed of 1,000 m/min.

Furthermore, Table 2 shows an unwinding tension difference obtained when the package of drawn yarn in Example 4 or that of drawn yarn in Comparative Example 1 was unwound while the unwinding speed was varied.

It is evident from Tables 1 and 2 that a package of drawn yarn showed good unwindability after storage over a long period of time as long as the drawing tension and the dry thermal shrinkage stress were in the ranges of the present invention and that the fabric obtained from the drawn yarn in the package was good.

In Comparative Example 1, the drawing tension was high, and fluff was often formed on the drawn yarn.

Moreover, the package of drawn yarn thus obtained had a high edge, and the unwinding tension difference was large. As a result, the fabric had poor quality.

TABLE 1

| | Ex. 1 | Ex. 2 | Ex. 3 | Ex. 4 | Ex. 5 | Ex. 6 | Comp. Ex. 1 |
|---|---|---|---|---|---|---|---|
| Drawing tension (cN/dtex) | 0.18 | 0.24 | 0.31 | 0.35 | 0.37 | 0.42 | 0.48 |
| Final godet roll speed | 2660 | 2935 | 3260 | 3395 | 3480 | 3630 | 3760 |

TABLE 1-continued

| | Ex. 1 | Ex. 2 | Ex. 3 | Ex. 4 | Ex. 5 | Ex. 6 | Comp. Ex. 1 |
|---|---|---|---|---|---|---|---|
| $R_2$ (m/min) | | | | | | | |
| Winding speed V (m/min) | 2500 | 2700 | 2900 | 2990 | 3030 | 3114 | 3500 |
| $V/R_2$ | 0.94 | 0.92 | 0.89 | 0.88 | 0.87 | 0.86 | 0.93 |
| Spinning stability | ◎ | ◎ | ◎ | ◎ | ◎ | ○ | x |
| Breaking elongation (%) | 72 | 64 | 55 | 52 | 50 | 48 | 43 |
| Dry thermal shrinkage stress (cN/dtex) | 0.04 | 0.07 | 0.10 | 0.10 | 0.12 | 0.15 | 0.19 |
| Diameter difference of package (mm) | 3 | 4 | 4 | 4 | 6 | 8 | 11 |
| Unwinding tension difference ΔF (cN/dtex) | 0.002 | 0.002 | 0.003 | 0.003 | 0.004 | 0.007 | 0.010 |
| Quality of fabric | ○ | ◎ | ◎ | ◎ | ◎ | ○ | x |
| Overall evaluation | ○ | ◎ | ◎ | ◎ | ◎ | ○ | x |

TABLE 2

| | | | | | |
|---|---|---|---|---|---|
| Unwinding speed u (m/min) | | 500 | 800 | 1000 | 1300 |
| Unwinding tension difference ΔF (cN/dtex) | Ex. 4 | 0.001 | 0.002 | 0.003 | 0.005 |
| | Comp. Ex. 1 | 0.006 | 0.008 | 0.010 | 0.013 |

EXAMPLES 7 AND 8

Comparative Examples 2 and 3

In the present examples, the effect of the ratio ($V/R_2$) of a winding speed V to a final heat treatment godet roll speed $R_2$ will be explained.

The procedure of Example 3 was repeated except that the winding speed was varied as shown in Table 3, and the results are shown in Table 3.

It is evident from Table 3 that a good package of drawn yarn and a fabric of excellent quality could be obtained as long as the ratio of a winding speed V to a final heat treatment godet roll speed $R_2$ was in the range of the present invention.

TABLE 3

| | Ex. 7 | Ex. 8 | Comp. Ex. 2 | Comp. Ex. 3 |
|---|---|---|---|---|
| Final godet roll speed $R_2$ (m/min) | 3395 | 3395 | 3395 | 3395 |
| Winding speed V (m/min) | 3000 | 3080 | 3180 | 3280 |
| $V/R_2$ | 0.89 | 0.91 | 0.94 | 0.96 |
| Winding tension (cN/dtex) | 0.04 | 0.12 | 0.18 | 0.23 |
| Dry thermal shrinkage stress (cN/dtex) | 0.10 | 0.12 | 0.17 | 0.20 |
| Diameter difference of package (mm) | 4 | 8 | 11 | 13 |
| Unwinding tension difference ΔF (cN/dtex) | 0.002 | 0.007 | 0.010 | 0.016 |
| Quality of fabric | ◎ | ○ | x | x |
| Overall evaluation | ◎ | ○ | x | x |

EXAMPLES 9 AND 10

Comparative Example 4

In the present examples, the effect of changing the traverse angle in accordance with a winding diameter will be explained.

The procedure of Example 1 was repeated except that the traverse angle was varied during winding in accordance with a winding diameter.

The changing pattern of a sharpness angle was selected from b, c or d illustrated in FIG. 8, and Table 4 shows the results.

It is clear from Table 4 that a good package of drawn yarn showing excellent unwindability was obtained when the pattern of changing the traverse angle was selected from the range of the present invention (b (Example 9) or c (Example 10)).

On the other hand, when the traverse angle was constant (Comparative Example 4) as shown by pattern d in FIG. 8, a package having a high edge was formed, and the package showed poor high speed unwindability.

TABLE 4

| | Ex. 9 | Ex. 10 | Comp. Ex. 4 |
|---|---|---|---|
| Pattern of traverse angle change | b in FIG. 8 | c in FIG. 8 | d in FIG. 8 |
| Dry thermal shrinkage stress (cN/dtex) | 0.04 | 0.04 | 0.05 |
| Diameter difference of package (mm) | 7 | 8 | 11 |
| Unwinding tension difference ΔF (cN/dtex) | 0.006 | 0.007 | 0.009 |
| Quality of fabric | ◎ | ○ | x |
| Overall evaluation | ◎ | ○ | x |

EXAMPLES 11 TO 14

In the present examples, the effect of the winding width of a package of drawn yarn will be explained.

The procedure of Example 4 was repeated except that the traverse width of the winder was varied as shown in Table 5 during winding. Table 5 shows the winding weight and shape of the package of drawn yarn thus obtained and the quality of the fabric thus obtained.

It is evident from Table 5 that as long as the winding width of a package of drawn yarn was in the preferred range of the invention, the package showed better unwindability and the fabric had better quality.

TABLE 5

| | Ex. 11 | Ex. 12 | Ex. 13 | Ex. 14 |
|---|---|---|---|---|
| Winding width of package (mm) | 85 | 110 | 190 | 300 |
| Winding diameter of package (mm) | 300 | 300 | 300 | 200 |
| Winding weight of package (kg) | 4.5 | 5.9 | 10.4 | 7.0 |
| Diameter difference of package (mm) | 5 | 4 | 4 | 3 |
| Unwinding tension difference ΔF (cN/dtex) | 0.003 | 0.005 | 0.006 | 0.008 |
| Quality of fabric | ◎ | ◎ | ◎ | ○ |
| Overall evaluation | ◎ | ◎ | ◎ | ○ |

EXAMPLES 15 TO 17

In the present examples, the effects of the driving system of a bobbin axis and a contact roll contacted therewith of a winder, and the ratio of a peripheral speed of the contact roll to a winding speed will be explained.

The procedure of Example 4 was repeated during winding except that the type of a winder and the ratio of a peripheral speed $V_c$ of a contact roll to a winding speed V were varied as shown in Table 6. Table 6 shows the results.

Take-up godet roll speed: 2,800 m/min

Final heat treatment godet roll speed $R_2$: 4,005 m/min

Drawing tension: 0.40 CN/dtex

Winding speed: 3,440 m/min

Winding tension: 0.04 cN/dtex

It is clear from Table 6 that when the peripheral speed $V_c$ of the contact roll was made larger than the winding speed V, a package of drawn yarn showing good unwindability and fabric quality was obtained regardless of a high winding speed.

TABLE 6

| | Ex. 15 | Ex. 16 | Ex. 17 |
|---|---|---|---|
| Driving force of contact roll | Yes | Yes | Yes |
| $V_c/V$ | 1.000(0%) | 1.004(0.4%) | 1.010(1.0%) |
| Diameter difference of package (mm) | 8 | 6 | 5 |
| Unwinding tension difference ΔF (cN/dtex) | 0.008 | 0.005 | 0.003 |
| Quality of fabric | ○ | ◎ | ◎ |
| Overall evaluation | ○ | ◎ | ◎ |

EXAMPLES 18 AND 19

Comparative Examples 5 AND 6

In the present examples, the effect of a temperature of a package of drawn yarn during winding will be explained.

The procedure of Example 4 was repeated except that the package temperature during winding was varied as shown in Table 7. Table 7 shows the shape and unwindability of a package of drawn yarn thus obtained.

It is evident from Table 7 that a package having a good winding shape and good unwindability was obtained as long as the package temperature during winding was in the range of the present invention.

TABLE 7

| | Ex. 18 | Ex. 19 | Comp. Ex. 5 | Comp. Ex. 6 |
|---|---|---|---|---|
| Package temperature during winding (° C.) | 25 | 30 | 35 | 40 |
| Diameter difference of package (mm) | 6 | 9 | 12 | 16 |
| Unwinding tension difference ΔF (cN/dtex) | 0.004 | 0.007 | 0.011 | 0.015 |
| Quality of fabric | ◎ | ○ | x | x |
| Overall evaluation | ◎ | ○ | x | x |

Industrial Applicability

The present invention provides a package of PTT drawn yarn obtained by a direct spin-draw process, having an industrially practical winding weight, and excellent in unwindability during high speed unwinding even after storage over a long period of time.

A fabric obtained by knitting or weaving using a package of PTT drawn yarn of the present invention is one having good quality without defects such as streaky defects and a tight yarn.

What is claimed is:

1. A package of poly(trimethylene terephthalate) drawn yarn that is a cheese-like package formed by winding a drawn yarn in a winding amount of 2 kg or more obtained by directly spinning and drawing a poly(trimethylene terephthalate) comprising 95% by mole or more of trimethylene terephthalate repeating units, the package satisfying the following requirements (1) to (4):

(1) the drawn yarn shows a dry thermal shrinkage stress of from 0.01 to 0.15 cN/dtex;

(2) the traverse angle is varied in accordance with a winding diameter of the package and selected from 3 to 10 degrees at each winding diameter, and the difference between the minimum and the maximum value thereof is at least one degree;

(3) the diameter difference between the edge portion and the central portion of the package is 10 mm or less; and (4) the unwinding tension difference ΔF (cN/dtex) during unwinding the drawn yarn having been wound into the package satisfies the following formula (1):

$$\Delta F \leqq 8.0\times10^{-6}u \quad (1)$$

wherein u is an unwinding speed (m/min).

2. The package of poly(trimethylene terephthalate) drawn yarn according to claim 1, wherein the dry thermal shrinkage stress of the drawn yarn is from 0.02 to 0.13 cN/dtex.

3. The package of poly(trimethylene terephthalate) drawn yarn according to claim 1 or 2, wherein the winding width of the package is from 60 to 200 mm, and the winding diameter thereof is from 200 to 400 mm.

4. The package of poly(trimethylene terephthalate) drawn yarn according to claim 1 or 2, wherein the traverse angle in the wound portion having a winding thickness exceeding 10 mm is larger than that in the wound portion having a winding thickness of 10 mm or less.

5. The package of poly(trimethylene terephthalate) drawn yarn according to claim 1 or 2, wherein the breaking elongation of the drawn yarn is from 40 to 90%.

6. A method for producing a package of poly(trimethylene terephthalate) drawn yarn, wherein a poly(trimethylene terephthalate) is drawn and heat treated using at least two pairs of godet rolls, in a direct spin-draw process of poly (trimethylene terephthalate), and the drawn yarn is wound into a package, the method satisfying the following requirements (a) to (d) during winding:

(a) the drawing tension is from 0.05 to 0.45 cN/dtex;

(b) the ratio $V/R_2$ of a winding speed V (m/min) to a final heat treatment godet roll speed $R_2$ (m/min) satisfies the following formula (2):

$$0.8 \leqq V/R_2 \leqq -6.6\times10^{-5}R_2+1.15 \quad (2)$$

provided that the final heat treatment godet roll speed $R_2$ is from 2,300 to 4,500 m/min;

(c) the traverse angle of winding during winding the drawn yarn into a package from the start to the end of winding is varied from 3 to 10 degrees in accordance with a winding diameter; and (d) the package during winding the drawn yarn is cooled to a temperature of 30° C. or less.

7. The method for producing a package of poly (trimethylene terephthalate) drawn yarn according to claim 6, wherein during winding a drawn yarn into a package by a direct spin-draw process, the drawn yarn is wound with a winder having both a bobbin axis and a contact roll contacted with the bobbin axis each having a driving force while the peripheral speed $V_c$ (m/min) of the contact roll is being made larger than the winding speed V (m/min) by 0.3 to 2%.

8. The method for producing a package of poly (trimethylene terephthalate) drawn yarn, according to claim 6 or 7, wherein the winding speed is from 1,800 to 3,800 m/min.

* * * * *